US006718719B1

(12) United States Patent
Hagerty

(10) Patent No.: US 6,718,719 B1
(45) Date of Patent: Apr. 13, 2004

(54) BATTEN STRIP FOR ROOF TILES

(76) Inventor: Quin J. Hagerty, 3749 Quinby Island Ct., Jacksonville, FL (US) 32224

( * ) Notice: Subject to any disclaimer, the term of this patent is extended or adjusted under 35 U.S.C. 154(b) by 0 days.

(21) Appl. No.: 10/082,396

(22) Filed: Feb. 25, 2002

(51) Int. Cl.[7] ..... E04D 1/00

(52) U.S. Cl. ..... 52/553; 52/478; 52/551; 52/302.3

(58) Field of Search ..... 52/553, 478, 551, 52/726.1, 730.7, 302.1, 302.3; 411/457, 469, 470, 471, 472, 473, 474, 475, 476, 459, 460, 441, 442, 443; 29/238, 281.1, 283, 283.5

(56) References Cited

U.S. PATENT DOCUMENTS

| | | | | | |
|---|---|---|---|---|---|
| 329,513 | A | * | 11/1885 | Underwood | 52/553 |
| 1,163,034 | A | * | 12/1915 | Phippen | 52/553 |
| 3,241,797 | A | * | 3/1966 | Anderson | 411/469 |
| 4,445,306 | A | | 5/1984 | Schauffele | |
| 4,718,211 | A | | 1/1988 | Russell et al. | |
| 5,242,736 | A | * | 9/1993 | Van Erden et al. | 428/137 |
| 5,329,653 | A | * | 7/1994 | Hultgren | 16/16 |
| 5,471,807 | A | | 12/1995 | Vasquez | |
| 5,794,396 | A | * | 8/1998 | Gibbs | 52/553 |
| 5,956,804 | A | * | 9/1999 | Dunne | 16/16 |
| 6,026,619 | A | * | 2/2000 | Hunt | 52/273 |
| 6,052,961 | A | * | 4/2000 | Gibbs | 52/518 |
| 6,223,492 | B1 | * | 5/2001 | Barnhart, Jr. et al. | 52/553 |
| 6,226,949 | B1 | * | 5/2001 | Huber | 52/553 |
| 6,357,193 | B1 | * | 3/2002 | Morris | 52/553 |
| 6,453,630 | B1 | * | 9/2002 | Buhrts et al. | 52/177 |

FOREIGN PATENT DOCUMENTS

| | | | | |
|---|---|---|---|---|
| CH | 651 344 A5 | * | 9/1985 | 52/553 |
| DE | 32 38 764 A1 | * | 4/1984 | 52/553 |
| GB | 1 337 653 | * | 11/1973 | 52/553 |
| WO | WO 83/01477 | * | 4/1983 | 52/553 |

OTHER PUBLICATIONS

National Roofing Contractor's Association (NRCA) Roofing And waterproofing Manual—Fourth Edition p. 1101, Fig. 2 (pp. 1091–1106 submitted)

6th International Conference on Woodfiber–Plastic Composites, May 15, 2001 (pp. 1–3 submitted).

* cited by examiner

*Primary Examiner*—Lanna Mai
*Assistant Examiner*—Dennis L. Dorsey
(74) *Attorney, Agent, or Firm*—Arthur G. Yeager

(57) ABSTRACT

The strip includes an elongated body having a pair of parallel sidewalls, an upper surface between sidewalls and a lower surface between sidewalls adapted to engage a water barrier on a wood roof. A plurality of spaced, inverted channels are formed along the body from the lower surface and terminate generally midway between the upper and lower surfaces. The channels extend between the body sidewalls and provide drainage perpendicular to the length of the body. The upper surface may be planar or be stepped. A plurality of spaced recesses with preset fasteners are disposed along the upper body surface.

14 Claims, 3 Drawing Sheets

BATTEN STRIP FOR ROOF TILES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a batten or furring strip and, more particularly, to a non-corrosive and non-rotting batten strip for roof tiles and having predrilled recesses carrying fasteners for simplifying the installation process onto a roof.

2. Prior Art

The overall effectiveness of a tile roof as a weatherproof assembly depends on the individual effectiveness of all the components in a roofing system. A particular component of a roofing system is a batten or furring strip. Batten strips are usually required when installing roof tiles, especially where a roof has a sloped shape. Batten strips are used to support tiles on roof surfaces and provide drainage for the roofing system. Many materials may be used to make batten strips, i.e., aluminum, wood and plastic. To be durable and cost-effective, batten strips should be formed of non-corrosive and non-rotting materials and should be installable with minimal requisite labor.

In addition, batten strips should provide adequate drainage for the roofing system. A particular problem with roofing systems is water and debris migration. Water migration refers to the movement of water beyond the primary roof covering material. For example, water may migrate between the side-lap joints of tiles and enter the roofing system. Wind-driven snow and rain and debris may migrate beneath tiles of many tile roofs. Also, the physical phenomenon of capillary action and surface tension, combined with wind, is a factor in the water and debris migration characteristics of some types of roofing systems. As a result, it is important for the underlining batten strips to be provided with adequate drainage.

Batten strips of the prior art with weep holes are more susceptible to becoming clogged with debris, which hinders the drainage of water through the weep holes. Increasing the dimensions for drainage should be considered where organic debris, i.e., leaves, pine needles, etc. may accumulate and clog the weep holes. Tile laid dry on batten strips increases the air circulation under the tile roof covering and assists in preventing water damage to the roofing system.

Alternative to a single system, a roofing system may encompass a batten/counter batten system as disclosed by the National Roofing Contractor's Association (NRCA), *Roofing and Waterproofing Manual-Fourth Edition*, page 1101, FIG. 2. However, such systems require more material and installation is tedious and time consuming, which results in higher costs.

U.S. Pat. No. 5,471,807 to Vasquez discloses a roofing system, which employs grooved batten members. The grooved batten members are preferably made of reprocessed plastic materials such as polyvinylchloride, polyethylene and polypropylene, for example. A shortcoming of the Vasquez '807 patent is that nails or screws must be forced through the batten members to secure the batten members to a roof surface. This requires an installer to carry a number of requisite tools. For example, an installer must carry nails/screws, a hammer, a circular saw and often a nail gun with a connected hose supplying air-pressure to the nail gun. These tools render the installation process more difficult and cumbersome, time consuming and expensive.

For example, to attach the batten strips on a roof, an installer must locate and individually place each nail/screw into the batten strip. Moreover, if only a portion of a batten strip is required for a roof surface, the installer must manually saw off the unnecessary portion of the batten strip. Such a process may cause uneven cuts, chips, and cracks to the batten strip and likely reduces the effectiveness of the batten strip.

U.S. Pat. No. 4,718,211 to Russell et al. discloses a batten bar made of plastic, corrosion-resistant material that has thick side portions. Holes are provided in the bridging portion. A fastener, which is shown as a self-tapping screw, has the shank thereof passed downwardly through one of the holes and through the membrane to be seated in a roof substrate. Power-operated screw-driving tools usually drive the fasteners. These tools are often heavy and require periodic battery replacement.

U.S. Pat. No. 4,445,306 to Schauffele discloses an elongated fastening bar which is placed above a roofing membrane and fastened to a roofing structure with fasteners, such as screws or nails. The fasteners are driven through the bar from the top thereof through the underlying membrane and into the roof structure. Preformed holes are provided in the bar along its longitudinal centerline at periodic intervals, such as every 12 inches. The Schauffele '306 patent discloses flat, inclined faces on the upper surface of the fastening bar causing water and debris to flow away therefrom.

BRIEF SUMMARY OF THE INVENTION

In view of the foregoing background, it is therefore an object of the invention to provide a batten strip for supporting roof tiles on a roof with a water barrier covering same. These and other objects, features, and advantages of the invention, are provided by a batten strip that may include an elongated body having a pair of substantially parallel sidewalls, an upper surface between the sidewalls, and a lower surface between the sidewalls adapted to engage a water barrier on a roof. The batten strip may further include a plurality of spaced, inverted channels having respective bases and a pair of sidewalls extending downwardly from the respective bases. The channels may be formed along the body from the lower surface and terminating generally midway between the upper and lower surfaces. The channels may extend between the sidewalls and provide drainage perpendicular to the length of the body. In one embodiment, the channels may have equal lengths along the elongated body. In an alternate embodiment, the channels may have variable respective lengths along the elongated body. In addition, the spacing between each channel may be substantially equal to the length of the channels. Advantageously, the plurality of spaced channels along the batten strip provide more effective drainage of water and debris for a roof system.

The batten strip may further include a plurality of spaced lands respectively located between adjacent channels. The plurality of lands may be adapted to be engaged with a water barrier on a roof surface. In one embodiment, the spaced lands may have a length equal to the length of the spaced channels. In an alternate embodiment, the spaced lands may have variable respective lengths.

The batten strip may further include a plurality of spaced recesses in and along the upper surface located generally equidistant between each pair of the adjacent channels. In addition, a plurality of fastening members may be pre-inserted into the respective plurality of recesses and carried by the body for securing the body to a roof. The plurality of fastening members may have sharpened lower ends inserted into and secured in position in the respective plurality of recesses until a driving force is applied thereto.

The plurality of fastening members may also have heads to be countersunk into the respective plurality of recesses so that the heads are flush with the upper surface of the body. The fastening members may be driven through the respective lands for securing the batten strip to a roof surface. Advantageously, the installer may secure the batten strip to a roof surface without having to locate and use nails/screws, a circular saw, an air-hammer with an attached hose or other cumbersome tools, thereby making the installation process less tedious and costly.

In addition, the elongated body of the batten strip may include opposite end portions. Each end portion may have a base and a sidewall so that when one batten strip is abutted end-to-end with another batten strip, another channel may be formed. Each end portion may be approximately half the length of a channel. Advantageously, a continuous row of batten strips may be created, with equally spaced channels, on the roof surface.

In an alternate embodiment, the body of the batten strip may have a first elongated section and a second elongated section parallel and adjacent thereto. The second section may be spaced downwardly from the first section so that the second section may have a thickness less than a thickness of the first section. In one embodiment, the plurality of recesses may be located in and along the first channel. In an alternate embodiment, the plurality of recesses may be located in and along the second channel.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime and double prime notations are used to indicate similar elements in alternate embodiments.

Figure 2:
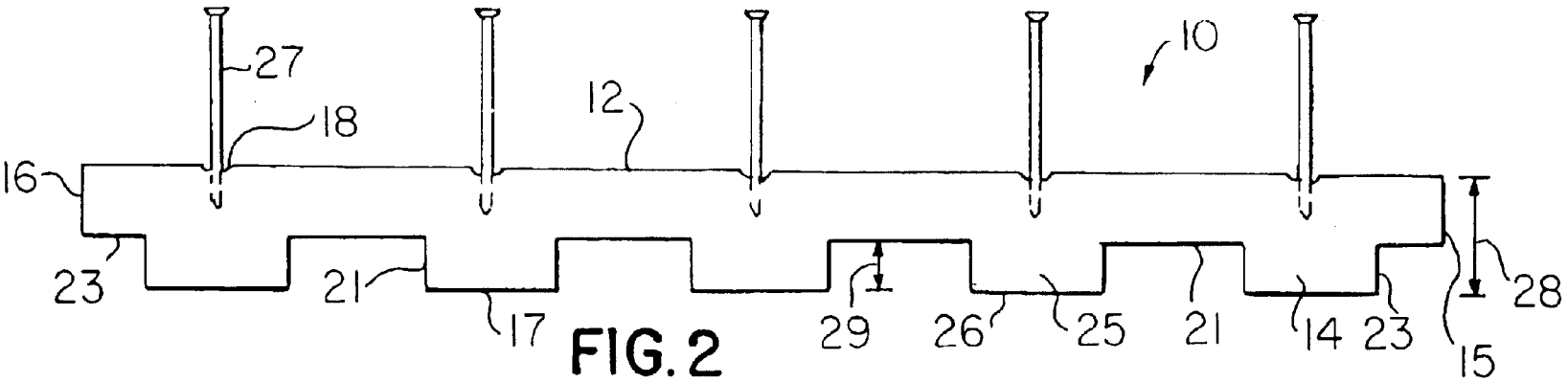
FIG. 2 is a front elevational view of the batten strip shown in FIG. 1.
Figure 1:
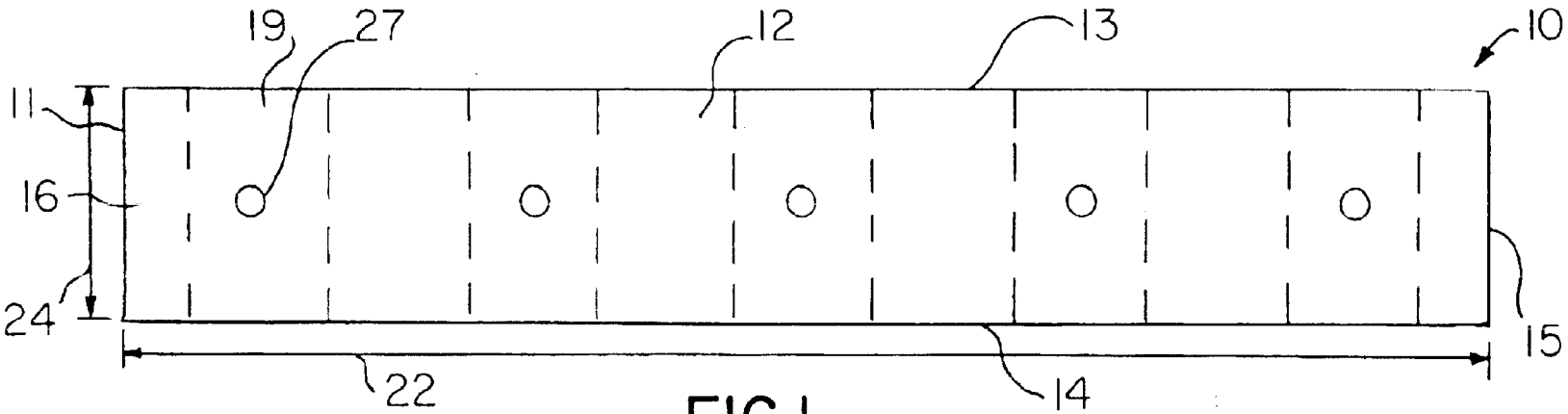
FIG. 1 is a top plan view showing the batten strip in accordance with the present invention.

Referring initially to FIGS. 1 and 2, a batten strip 10 having a generally elongated body 12 with parallel sides 13, 14 and parallel ends 15, 16 is illustrated in accordance with the present invention. A plurality of spaced, inverted channels 21 are located along an underside 17 of the body. A partial, inverted channel 23 are at each respective end 15, 16 of the batten strip. In addition, a plurality of spaced lands 25 are located interspersed between the plurality of channels 21. Each land 25 has a generally planar bottom surface 26. Each bottom surface is supported by a roof surface (not shown).

The batten strip 10 preferably has a length 22 of approximately thirty inches, a width 24 of approximately one and one-half inches, and a thickness 28 of approximately three-quarters of an inch, and such dimensions are substantially the same as the batten strips commercially available to the roof tile contractors and installers. The channels 21 and lands 17 have a three-inch length with the end channels 23 being one and one-half inches in length. The depth 29 of the channels is preferably five-sixteenths of one inch. Other dimensions are readily achievable by one of ordinary skill in the art without deviating from the scope or spirit of the invention. For example, the batten strip may include a plurality of channels, wherein the channels and/or the lands have different dimensions. The dimensions may be varied to adapt to the severity of the debris and/or normal weather conditions to which the batten strips and tile roof are exposed. A batten strip installed around many trees or in a severe climate may require larger channels than a batten strip installed in an area that has less trees and/or milder climates.

A plurality of spaced recesses 18 are predrilled along the topside 19 of the batten strip. The recesses 18 are generally located equidistant from the sides 13, 14 of the batten strip and above the lands 25. Fastening members 27 are preset into the recesses 18, which will later be tapped through the batten strip into the roof surface for securing the batten strip. The fastening members 27 may include nails, screws or other similar fasteners known to the art.

Figure 3:
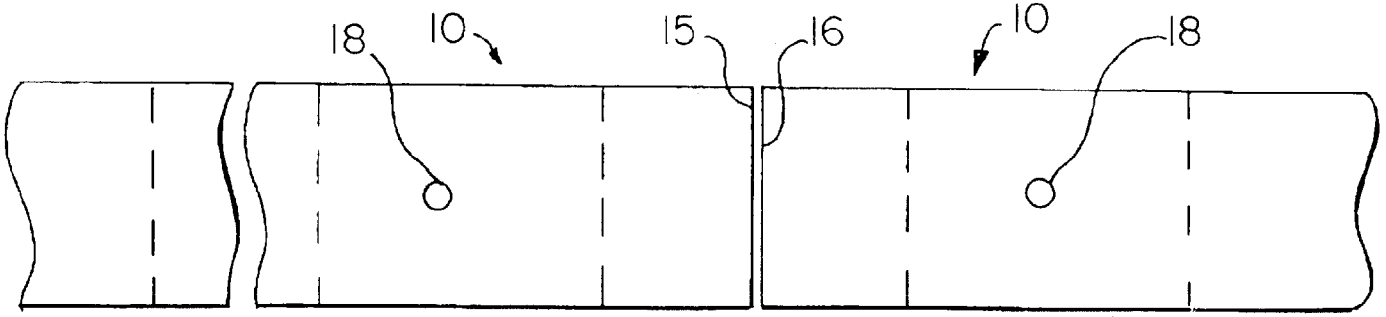
FIG. 3 is a partial, enlarged top plan view of abutting batten strips of FIG. 1.
Figure 4:
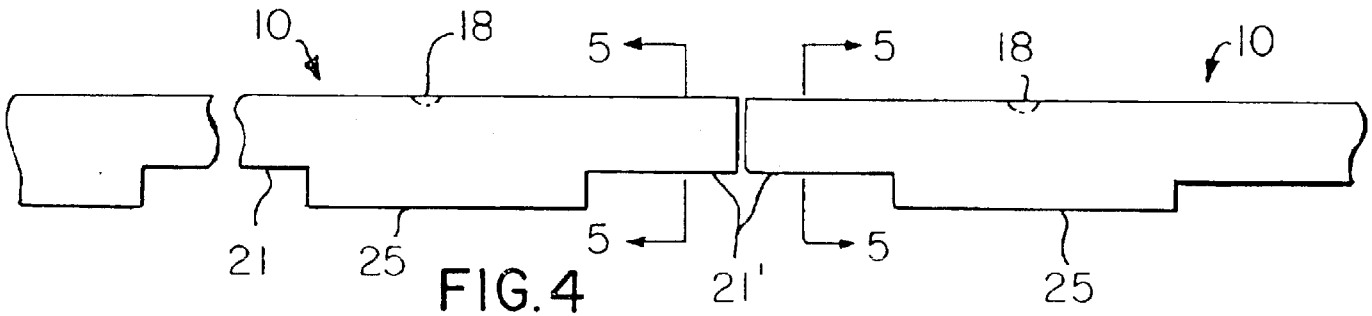
FIG. 4 is a front elevational view of FIG. 3.
Figure 5:
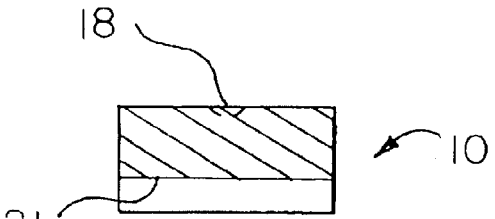
FIG. 5 is a cross-sectional view along line 5—5 of the batten strips of FIG. 4.
Figure 6:
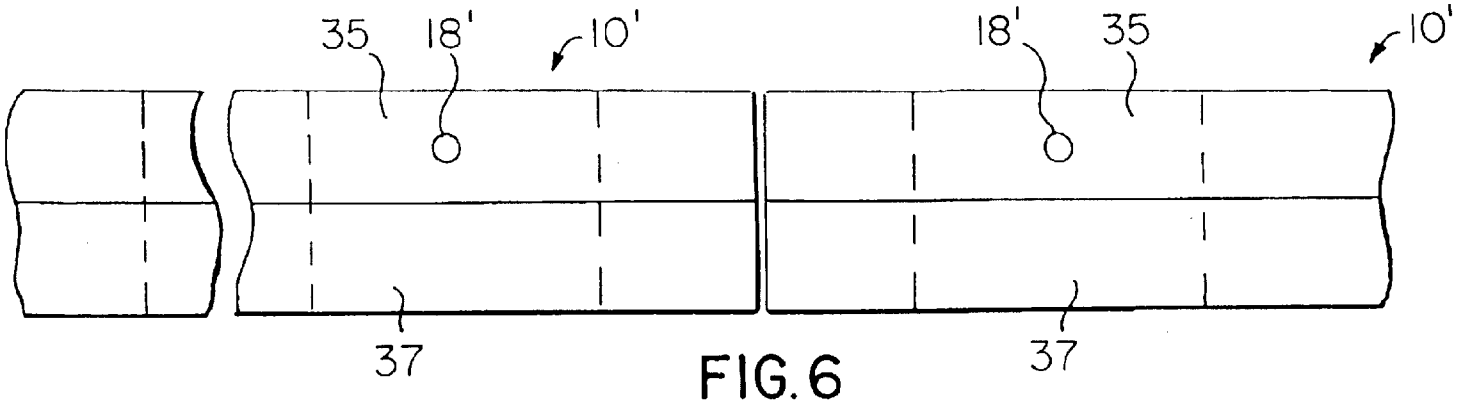
FIG. 6 is a top plan view showing an alternate embodiment of the batten strip in accordance with the present invention.
Figure 7:
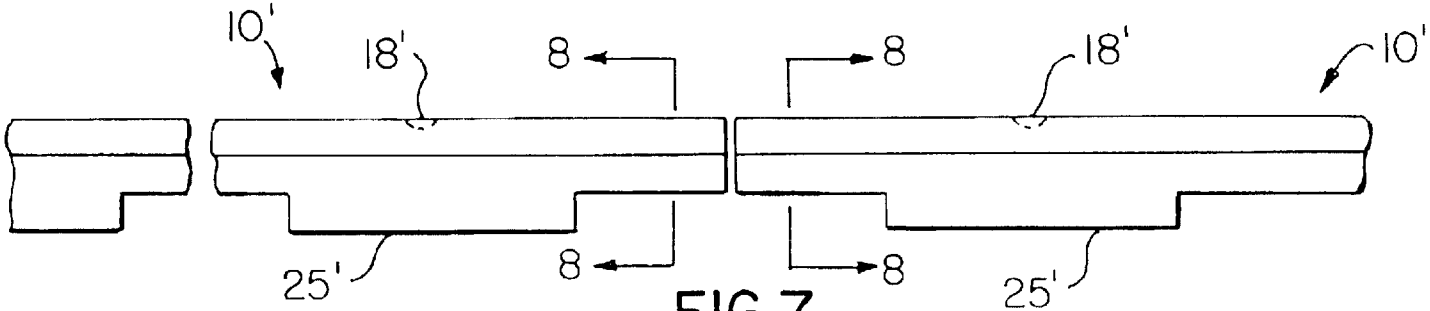
FIG. 7 is a front elevational view of the batten strip of FIG. 6.

Referring now to FIGS. 3–5, two adjacent and separate batten strips 10 are illustrated in an end-to-end relationship and each has a generally elongated shape with opposite ends 15, 16 abutting each other. Each end 15, 16 of each batten strip defines a partial or reduced channel 23 with the partial channels 23 forming a complete channel 21', just like the other channels 21 of batten strip 10. The lands 25 form the contact surface for attaching the batten strip to a moisture barrier (not shown) attached to and above the wood roof surface (not shown). Each land 25 preferably has the same length dimension as each channel 21, 21'. However, the lands 25 may vary in size as necessary for their structural integrity and the application of the batten strip.

By providing recesses 18 containing partial pre-drilled holes, fastening members 27 may be inserted into the recesses and affixed therein to simplify the installation process for an installer. Therefore, to install a batten strip 10, an installer simply needs a hammer (not shown) to drive the fastening members 27 into the roof surface. The necessity for carrying nails/screws and/or and an air gun having an attached hose is accordingly eliminated.

The batten strip is formed from a wood-filled plastic composite, referred to in the industry as plastic wood. Plastic wood is non-corrosive and non-rotting. Accordingly, plastic wood is durable and can sustain extreme temperatures without compromising its strength. The risk of bowing, bending, cracking, breaking, etc. is therefore minimized. Plastic wood is composed of recycled wood and plastic particles. Advantageously, plastic wood helps to preserve the rain forests and prevents the unnecessary deposits of plastics in the environment. In addition, a plastic wood batten strip may be readily shortened to the dimensions of the roof by simply breaking off any unnecessary portion with a hammer. The $6^{th}$ International Conference on Woodfiber-Plastic Composites, May 15, 2001, is hereby incorporated by reference for a more thorough discussion of the beneficial characteristics of plastic wood.

By placing the batten strip on an edge of a surface, with the unwanted portion hanging over the edge or on another batten strip prior to nailing, and the unwanted portion may be broken off by striking it with a hammer. Because the batten strips are made from plastic wood, the risk of forming burrs or jagged edges are substantially decreased. Advantageously, a manual or power saw is not needed and such elimination will not require the installer to carry, locate or use multiple tools, thereby simplifying the installation process, saving time and reducing labor costs.

Now referring to FIGS. 6–9, an alternate embodiment of the batten strips 10' are illustrated with the batten strips 10' each having a first section 35, respectively, and a downwardly stepped second section 37, respectively, along their length. The first and second sections 35, 37 are preferably equal and symmetrical, but may vary in dimension without departing from the spirit and scope of the present invention.

The first section 35 has a thickness at the lands 25' equal to the largest thickness of the batten strip 10'. The second section 37 has a thickness at the lands 25' that is less than the thickness of the first section 35. Not only does this cross-section 50' of the stepped embodiment reduce the amount of plastic wood used in each batten strip and thus reduce the cost to produce and ship, but the batten strip is more easily broken by a hammer blow. By reducing the cross-section 50' of the second section 37, the reduced weight also makes it easier to handle and install.

Figure 8:
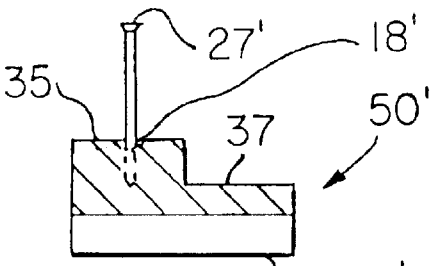
FIG. 8 is a cross-sectional view along line 8—8 showing a pre-inserted nail in a first section of the batten strip of FIG. 7.
Figure 9:
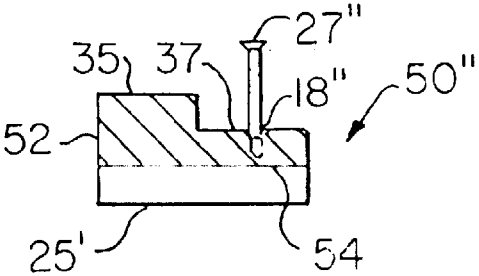
FIG. 9 is a cross-sectional view, along line 9—9, similar to FIG. 8 with a pre-inserted nail in a second section of batten strip of FIG. 7.

It may be seen that the preformed recesses 18' may be provided in the first section 35, as best shown in FIG. 8, or alternatively may be located in the second section 37, as best shown in FIG. 9. The fastening members 27' may then be partially inserted into the preformed recesses 18' and ready for the installer to hammer them through the batten strip and moisture barrier into the roof surface for attaching the batten strip thereto. If the fastening members 27" are located in the second section as seen in FIG. 9, the length of the necessary fastening members 27" may be shortened by about the step reduction illustrated between the first and second sections 35, 37.

If the embodiments of FIGS. 6–9 are used, the thicker first section 35 would be installed on the higher elevation of a sloped roof so that the tiles (not shown) affixed thereto would have the greatest structural support, it being understood that the second section 37 would not be engaged by the tiles even if the second section was as thick as the first section 35, i.e., like the embodiments of FIGS. 1–5.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A batten strip for supporting roof tiles on a wood roof with a water barrier covering same, the batten strip comprising:

an elongated body having a pair of substantially parallel sidewalls, an upper surface between said sidewalls, and a lower surface between said sidewalls adapted to engage a water barrier on a roof;

a plurality of spaced, inverted channels having respective bases extending parallel to said upper and lower surfaces and a pair of remotely spaced sidewalls extending downwardly from respective said bases, said channels being formed along said body from said lower surface and terminating generally midway between said upper and lower surfaces, said channels extending between said sidewalls and providing drainage perpendicular to a length of said body;

a plurality of spaced recesses in and along said upper surface located generally equidistant between each pair of adjacent said channels; and a plurality of fastening members pre-inserted into respective said plurality of recesses and carried by said body for securing said body to a roof, said plurality of fastening members having sharpened lower ends inserted into and secured in position in respective said plurality of recesses until a driving force is applied thereto, said plurality of fastening members having heads to be countersunk into respective said plurality of recesses so that said heads are flush with said upper surface, said fastening members lower ends being fully embedded within said strip and not protruding outwardly thereof.

2. The batten strip as recited in claim 1, wherein said body has a first elongated section and a second elongated section parallel and adjacent thereto, said second section being spaced downwardly from said first section so that said second section has a thickness less than a thickness of said first section.

3. The batten strip as recited in claim 1, wherein said body includes opposite end portions, each said opposite end portion having a base and a side wall forming one-half of said channel so that when one said batten strip is abutted end to end with another said batten strip another of said channels is formed.

4. The batten strip as recited in claim 1, wherein said body is formed of a non-corrosive and non-rotting plastic composite.

5. A batten strip for supporting roof tiles on a wood roof with a water barrier covering same, the batten strip:

an elongated body having a predetermined length and a pair of substantially parallel sidewalls, an upper surface between said sidewalls, a lower surface between said sidewalls adapted to engage a water barrier on a roof, a first section and a second section adjacent thereto, said second section being spaced downwardly from said first section so that said section has a thickness less than a thickness of said first section;

a plurality of inverted channels spaced along said length of said body and having respective bases and a pair of remotely spaced sidewalls extending downwardly from respective said bases, said channels being formed along said body from said lower surface and terminating at their respective bases generally midway between said upper and lower surfaces, said bases being parallel to said upper and lower surfaces and extending between said sidewalls, said channels being equal in length; a plurality of spaced recesses in and along one of said sections and located generally equidistant between each pair of adjacent said channels, said channels being spaced substantially equal to said length of said channels; and a plurality of fastening members pre-inserted into respective said plurality of recesses and carried by said body for securing said body to a roof, said plurality of fastening members having sharpened lower ends inserted into and secured in position in respective said plurality of recesses until a driving force is applied thereto to cause protrusion of said lower ends outwardly of said strip, said plurality of fastening members having heads to be countersunk into respective said plurality of recesses so that said heads are flush with said upper surface.

6. The batten strip as recited in claim 5, wherein said plurality of recesses are located in and along said first section.

7. The batten strip as recited in claim 5, wherein said plurality of recesses are located in and along said second section.

8. The batten strip as recited in claim 5, wherein said body comprises of a non-corrosive and non-rotting plastic composite.

9. The batten strip as recited in claim 5, wherein said body includes opposite end portions, each said end portion having a base and a side wall so that when one said batten is abutted end to end with another said batten another said channels is formed.

10. A batten strip for supporting roof tiles on a wood roof with a water barrier covering same, the batten strip comprising:

an elongated body having a pair of substantially parallel sidewalls, an upper surface between said sidewalls, and a lower surface between said sidewalls adapted to engage a water barrier on a roof;

a plurality of spaced, inverted channels having respective bases and a pair of sidewalls extending downwardly from respective said bases, said channels being formed along said body from said lower surface and terminating generally midway between said upper and lower surfaces, said channels extending between said sidewalls;

a plurality of spaced lands respectively located between adjacent said channels;

a plurality of spaced recesses in and along said body and located generally equidistant between each pair of adjacent said channels; and a plurality of fastening members pre-inserted into respective said plurality of recesses and carried by said body for securing said body to a roof with said lands adapted to be engaged with a water barrier on a roof, said plurality of fastening members having sharpened lower ends inserted into and not extending outwardly of said strip and secured in position in respective said plurality of recesses until a driving force is applied thereto, to cause protrusion of said lower ends outwardly of said strip, said plurality of fastening members having heads to be countersunk into respective said plurality of recesses so that said heads are flush with said upper surface with said fastening members driven through said lands.

11. The batten strip as recited in claim 10, wherein said body has a first section and a second section adjacent thereto, said second section being spaced downwardly from said first section so that said second section has a thickness less than a thickness of said first section.

12. The batten strip as recited in claim 10, wherein said channels have a length and said lands have a length equal to said length of said channels.

13. The batten strip as recited in claim 10, wherein said body comprises of a non-corrosive and non-rotting plastic composite.

14. The batten strip as recited in claim 10, wherein said body includes opposite end portions, each said end portion having a base and a side wall forming one-half of said channel so that when one said batten is abutted end to end with another said batten another said channels is formed.

* * * * *